US008534098B1

(12) United States Patent
Zakuskin

(10) Patent No.: US 8,534,098 B1
(45) Date of Patent: Sep. 17, 2013

(54) PADLOCK

(75) Inventor: Yuriy Zakuskin, Orekhov (UA)

(73) Assignee: OAK Novations, Ltd., Middlesex, NJ (US)

( * ) Notice: Subject to any disclaimer, the term of this patent is extended or adjusted under 35 U.S.C. 154(b) by 0 days.

(21) Appl. No.: 13/481,817

(22) Filed: May 26, 2012

(51) Int. Cl.
*E05B 37/02* (2006.01)

(52) U.S. Cl.
USPC ..... 70/26; 70/52; 70/53; 70/133; 70/311; 70/312; 70/329

(58) Field of Classification Search
USPC ..... 70/22–26, 133, 308, 309, 311, DIG. 7, 70/DIG. 21, DIG. 44, DIG. 75, DIG. 76, 70/312, 51–53, 286–291, 301, 304, 307, 70/329
See application file for complete search history.

(56) References Cited

U.S. PATENT DOCUMENTS 526,740 A * 10/1894 Rapaport ..... 70/25
615,525 A * 12/1898 Brodie ..... 70/25
923,744 A * 6/1909 Whalen ..... 70/25
940,762 A * 11/1909 Whalen ..... 70/25
981,140 A * 1/1911 Tamburini ..... 70/311
1,012,388 A * 12/1911 Mandula ..... 70/312
1,018,756 A * 2/1912 Gordon ..... 70/23
1,224,168 A * 5/1917 Herman ..... 70/25
1,259,519 A * 3/1918 Jakopets ..... 70/25
1,267,894 A * 5/1918 Olson ..... 70/30
1,497,793 A * 6/1924 Saunders et al. ..... 70/312
1,510,635 A * 10/1924 Strmic ..... 70/30
1,527,727 A * 2/1925 Zweiman ..... 70/25
1,555,229 A * 9/1925 Offelder ..... 70/23
1,583,635 A * 5/1926 Wildrick ..... 70/25
1,773,204 A * 8/1930 Scheibner ..... 70/26
2,018,745 A * 10/1935 Schlitz ..... 70/303 R
3,264,851 A * 8/1966 Kimball ..... 70/312
5,540,065 A * 7/1996 Wyers ..... 70/26

* cited by examiner

*Primary Examiner* — Llyod Gall
(74) *Attorney, Agent, or Firm* — Cygney IP Law, P.A.; Stepgeb W. Aycock, II

(57) ABSTRACT

A padlock includes a shackle having a channel disposed along an axis of the shackle. The padlock also has a plurality of dials each having a single detent. The shackle can also include a plurality of circumferential grooves formed in a spaced arrangement along the shackle, each groove corresponding to one of the dials.

8 Claims, 6 Drawing Sheets

PADLOCK

Embodiments relate generally to padlocks, and more particularly to padlocks having removable dials axially aligned with a shackle.

Some conventional padlocks may have a fixed combination that is set by the factory at manufacture time. Dial padlocks may have a fixed set of dials that are not removable or changeable. Also, some conventional padlocks have dials that are not aligned with the lock shackle and thus may have additional components or complexity.

Embodiments were conceived in light of the above-mentioned problems and limitations, among other things.

An embodiment includes a padlock having a shackle having a channel disposed along an axis of the shackle and a plurality of dials each having a detent formed to slidably move through the channel when the detent is substantially aligned with the channel. The padlock can also include a plurality of circumferential grooves formed in a spaced arrangement along the shackle, each groove corresponding to one of the dials and formed such that the detent can rotate in the groove about the shackle.

The shackle can include a handle portion having a perpendicular member. The padlock can include a spring (e.g., a biasing spring) disposed between a body of the lock and the dials and configured to urge and help keep the dials in position.

The handle portion can include a ring or a knurled grip.

An embodiment can include one or more slots and a ring disposed at a distal end of the shackle. An embodiment can include a rotating knob or a knurled knob.

Another embodiment includes a combination lock having a body portion having a square indention formed on an inside surface of a bottom thereof and a plurality of removable dials disposed within the body portion and in axial alignment with a lock shackle, the lock shackle having a square distal end portion adapted to fit into the square indention when the shackle is inserted into the body. The combination lock can also include a removable cap adapted to permit removal of one or more dials.

The shackle can include a channel formed lengthwise along a portion of the shackle.

Each dial can include one or more detents corresponding to one or more channels in the shackle. The shackle can have a plurality of circumferential grooves formed in a spaced arrangement along the shackle, each groove corresponding to one of the dials.

DETAILED DESCRIPTION

Figures 1, 2, 3, 4, 5:
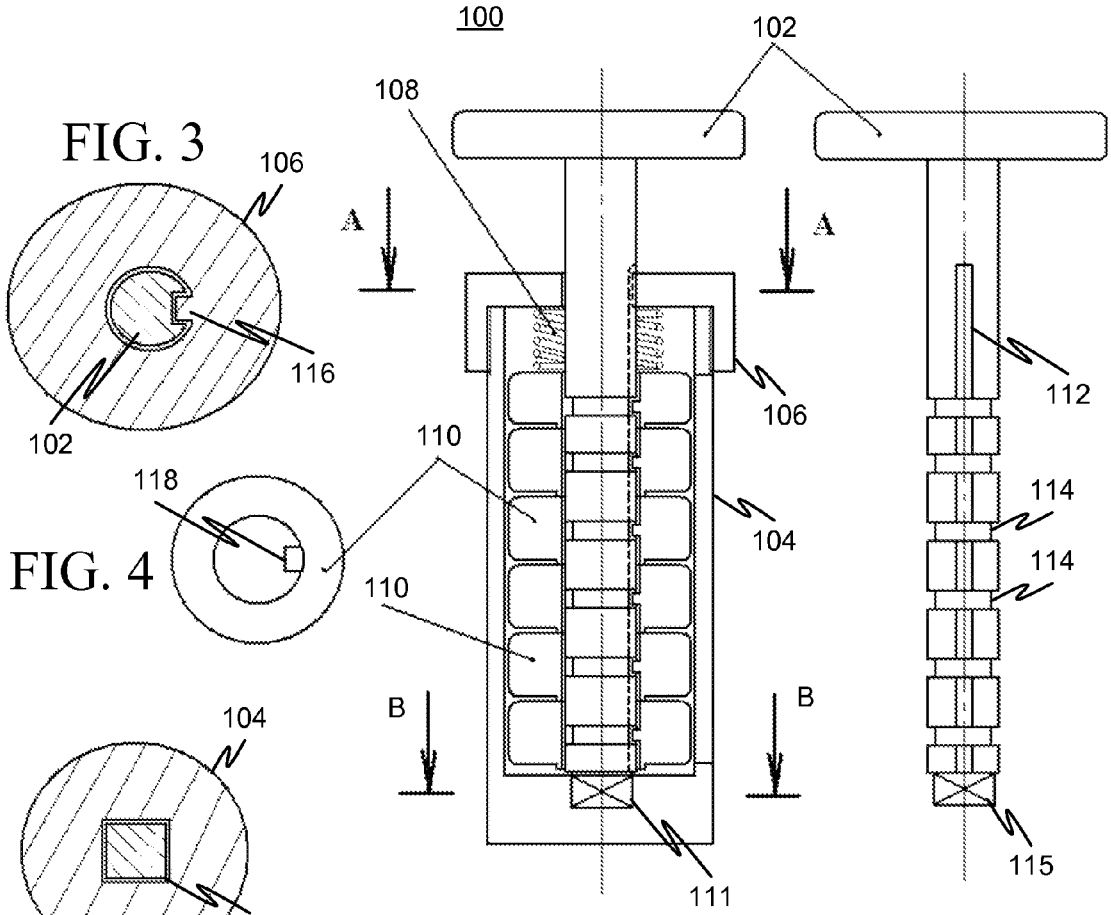
FIG. 1 is a cross sectional view of an example padlock in accordance with at least one embodiment.
FIG. 2 shows a diagram of an example padlock shackle in accordance with at least one embodiment.
FIG. 3 is a cross sectional view of the padlock of FIG. 1.
FIG. 4 is a dial in accordance with at least one embodiment.
FIG. 5 is a cross sectional view of the padlock shown in FIG. 1.

FIG. 1 is a cross sectional view of a padlock 100 having a shackle 102, a body portion 104, a cap 106, a spring 108, a plurality of dials 110 and an indentation 111.

FIG. 2 shows a diagram of an example padlock shackle 102 having a channel 112 formed lengthwise along a portion of the shackle 102 and a plurality of circumferential grooves 114 formed in a spaced arrangement along the shackle 102. Each of the grooves 114 corresponds to one of the dials 110 and provides a space for a dial and dial detent (see FIG. 4, detent 118) to rotate about the shackle 102. When the detents of all of the dials are aligned with the channel 112 of the shackle 102, the shackle can be removed from the body portion 104. In other words, the correct lock combination is one in which all of the dial detents are aligned with the channel 112 of the shackle 102. Any other arrangement of the dials will prevent the shackle 102 from being removed from the body portion 104.

The shackle also includes an end portion 115 having a square shape. The end portion 115 is adapted to fit into the indentation 111 of the body portion 104 and help keep the shackle 102 aligned in a fixed position (rotationally) with respect to the body portion 104.

FIG. 3 is a cross sectional view of the padlock of FIG. 1 at line A-A. In particular, FIG. 3 shows the cap 106 and a detent on the cap 116 that helps to keep the shackle 102 in a fixed position (rotationally) with respect to the body portion 104.

FIG. 5 is a cross sectional view of the padlock body 104 near a bottom portion. FIG. 5 shows the square shaped indentation 111 discussed above. While the indentation 111 and shackle end portion 115 are shown as square shaped members, other shapes could be used. In general any shape that would help prevent rotation of the shackle 102 relative to the body portion 104 could be used.

In operation, when all of the dials 110 are positioned such that the detents of each dial are substantially aligned with the channel 112 on the shackle 102, the shackle 102 can be inserted or removed from the body 104. Once the shackle 102 has been inserted into the body 104, the dials can be rotated to move the detents out of alignment with the channel 112 and into other positions in corresponding grooves to lock the padlock and prevent removal of the shackle 102.

It will be appreciated that the shackle and each dial could have more than one channel and detent, respectively.

Figure 6:
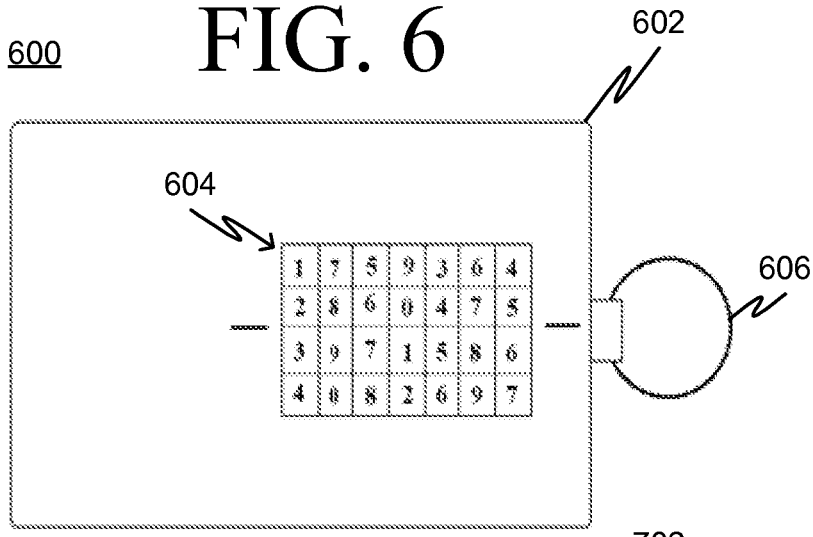
FIGS. 6 and 7 are diagrams of example padlocks in accordance with at least one embodiment.
Figure 7:
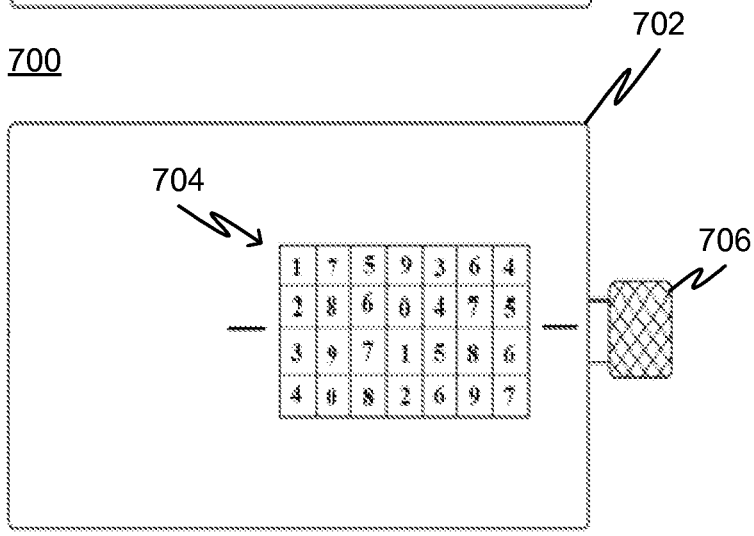
Figure 10:
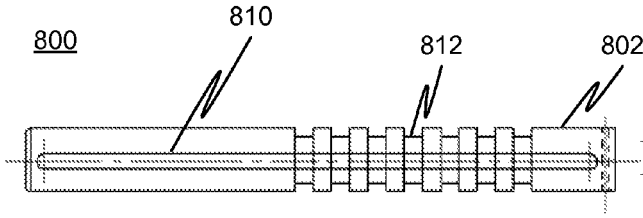
FIGS. 8-11 are diagrams of an example padlock in accordance with at least one embodiment.
Figure 9:
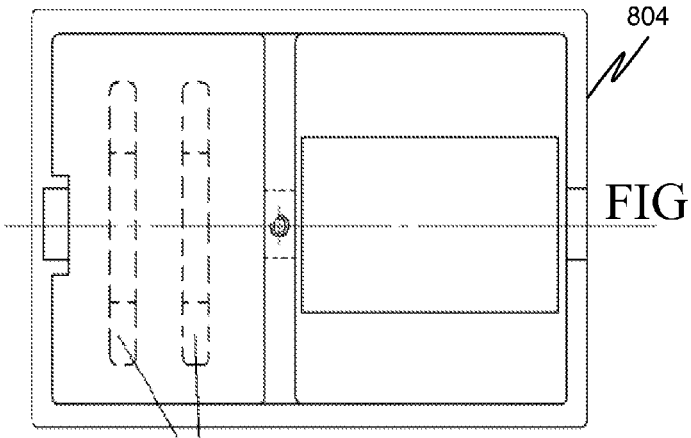
Figure 11:
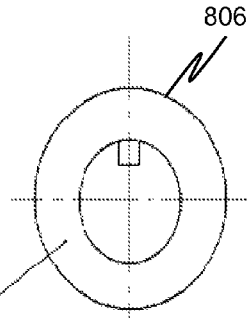

FIGS. 6 and 7 are diagrams of example padlocks 600 and 700, respectively, showing an outside view. The locks (600 and 700) include body portions (602 and 702) and a plurality of dials (604 and 704). Lock 600 includes a shackle having a ring 606. Lock 700 includes a shackle having a knurled knob 706. Locks 600 and 700 operate as described above with respect to FIGS. 1-5.

FIGS. 8-11 are diagrams of another embodiment of a padlock. The padlock 800 has a shackle 802, a body 804 with one or more slots 805, a plurality of dials 806 and a ring 808 attached to the shackle. The shackle 802 has a lengthwise channel 810 and a plurality of grooves 812 in a spaced arrangement. Each groove 812 corresponds to one or the dials 806. The padlock 800 operates in a manner similar to that described above for FIGS. 1-5.

Figure 8:
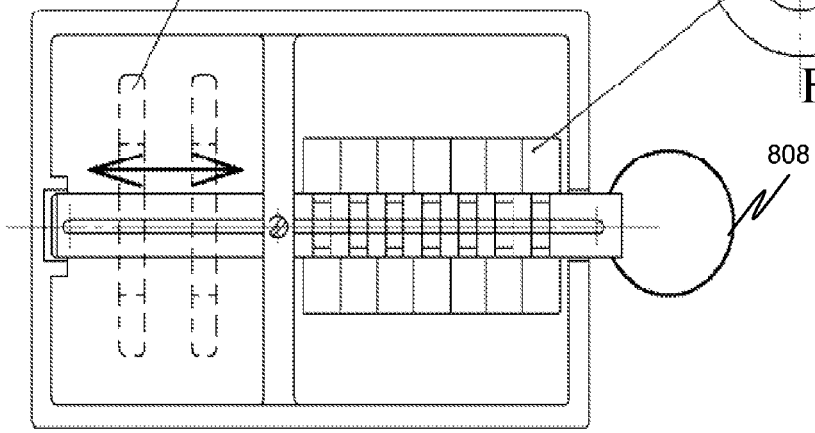

A difference between the padlock 800 shown in FIG. 8 and the padlock 100 shown in FIG. 1 is that an item can be passed through one or more of the slots 805 of the padlock 800 and engaged by the shackle 802 when the shackle 802 is inserted into the body 804.

Figure 12:
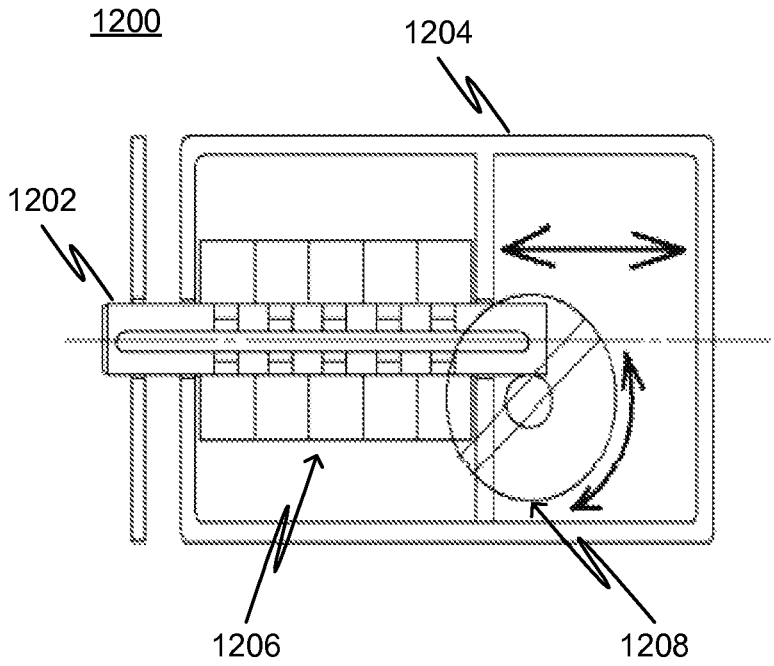
FIG. 12 is a diagram of an example padlock in accordance with at least one embodiment.

FIG. 12 is a diagram of an example padlock 1200 having a shackle 1202, a body portion 1204, one or more dials 1206 and a rotating knob 1208. The knob 1208 can rotate when detents in the dials (not shown) are aligned with a channel in the shackle 1202 (as described above).

Figure 13:
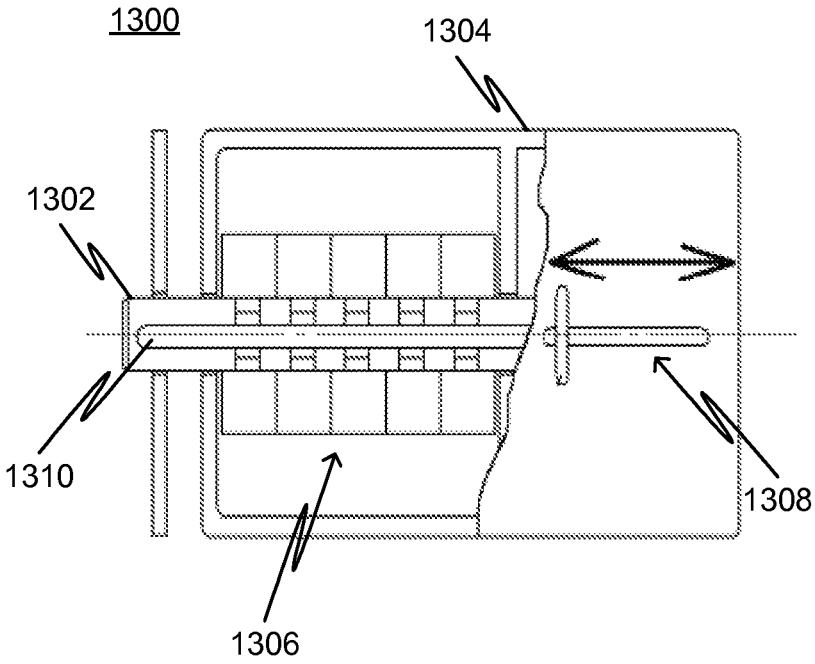
FIG. 13 is a diagram of an example padlock in accordance with at least one embodiment.
Figure 14:
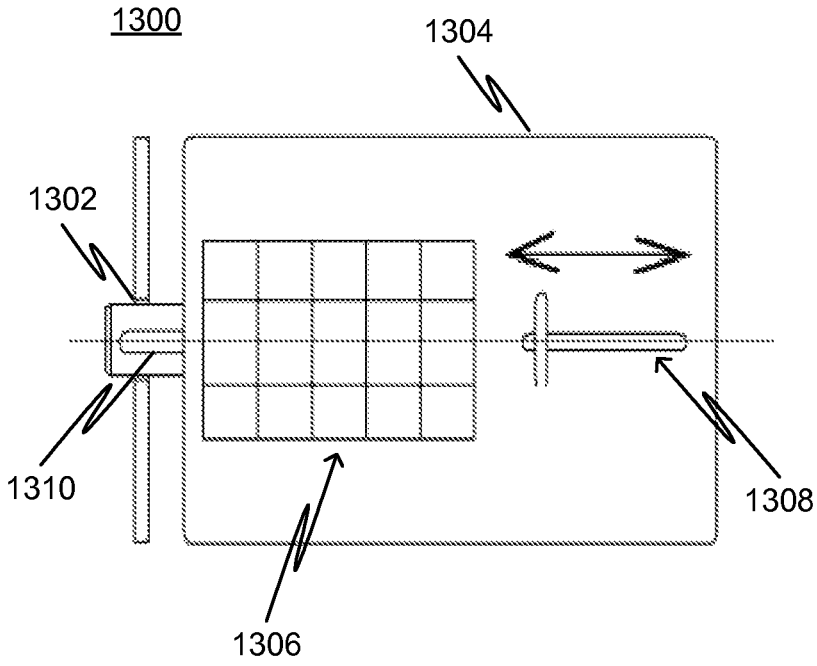
FIG. 14 is a diagram of an example padlock in accordance with at least one embodiment.

FIGS. 13 and 14 are diagrams of an example padlock 1300 having a shackle 1302, a body portion 1304, one or more dials 1306 and a slider 1308. The slider 1308 can move when detents in the dials (not shown) are aligned with a channel 1310 in the shackle 1302 (as described above).

It is, therefore, apparent that there is provided, in accordance with the various embodiments disclosed herein, padlocks having removable dials with one or more detents and/or dials with one or more detents in substantial alignment with a shackle having one or more corresponding channels.

While the invention has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of the invention.

What is claimed is:

1. A padlock comprising:

a shackle having a channel disposed along an axis of the shackle;

a plurality of dials each having a detent formed to slidably move through the channel when the detent is substantially aligned with the channel;

a plurality of circumferential grooves formed in a spaced arrangement along the shackle, each groove corresponding to one of the dials and formed such that the detent can rotate in the groove about the shackle;

a removable cap adapted to permit removal of one or more dials, wherein the removable cap includes a detent formed to slidably move through the channel in the shackle when the detent is substantially aligned with the channel.

2. The padlock of claim 1, further including a biasing spring disposed between the cap of the padlock and the dials.

3. The padlock of claim 1, further comprising a knob.

4. The padlock of claim 1, further comprising a knurled knob.

5. A combination lock comprising:

a body portion having a square indention formed on an inside surface of a bottom thereof;

a plurality of removable dials disposed within the body portion and in axial alignment with a lock shackle, the lock shackle having a square distal end portion adapted to fit into the square indention when the shackle is inserted into the body portion;

a removable cap adapted to permit removal of one or more dials, wherein the removable cap includes a detent formed to slidably move through a channel in the lock shackle when the detent is substantially aligned with the channel.

6. The combination lock of claim 5, wherein the shackle has the channel formed lengthwise along a portion of the shackle.

7. The combination lock of claim 5, wherein each dial has a single detent.

8. The combination lock of claim 7, wherein the shackle has a plurality of circumferential grooves formed in a spaced arrangement along the shackle, each groove corresponding to one of the dials.

* * * * *